US008098217B2

(12) United States Patent
Shoji et al.

(10) Patent No.: US 8,098,217 B2
(45) Date of Patent: Jan. 17, 2012

(54) DRIVING DEVICE AND DRIVING METHOD OF PLASMA DISPLAY PANEL AND PLASMA DISPLAY DEVICE

(75) Inventors: Hidehiko Shoji, Osaka (JP); Takahiko Origuchi, Osaka (JP)

(73) Assignee: Panasonic Corporation, Osaka (JP)

( * ) Notice: Subject to any disclaimer, the term of this patent is extended or adjusted under 35 U.S.C. 154(b) by 955 days.

(21) Appl. No.: 12/066,552

(22) PCT Filed: Sep. 13, 2006

(86) PCT No.: PCT/JP2006/318187

§ 371 (c)(1),
(2), (4) Date: Mar. 12, 2008

(87) PCT Pub. No.: WO2007/032403

PCT Pub. Date: Mar. 22, 2007

(65) Prior Publication Data

US 2010/0128023 A1 May 27, 2010

(30) Foreign Application Priority Data

Sep. 14, 2005 (JP) ..... 2005-266559

(51) Int. Cl.
*G09G 3/28* (2006.01)

(52) U.S. Cl. ..... 345/60

(58) Field of Classification Search ..... 345/60–63, 345/76; 315/169.4
See application file for complete search history.

(56) References Cited

U.S. PATENT DOCUMENTS

| | | | | |
|---|---|---|---|---|
| 6,294,875 | B1 | 9/2001 | Kurata et al. | |
| 6,876,343 | B2 * | 4/2005 | Myoung et al. | 345/67 |
| 7,075,239 | B2 * | 7/2006 | Kang et al. | 315/169.3 |
| 2001/0020923 | A1 * | 9/2001 | Homma | 345/60 |
| 2003/0107532 | A1 * | 6/2003 | Choi | 345/60 |

(Continued)

FOREIGN PATENT DOCUMENTS

JP 2000-242224 9/2000

(Continued)

OTHER PUBLICATIONS

English language Abstract of JP 2003-177695.

(Continued)

*Primary Examiner* — Chanh Nguyen
*Assistant Examiner* — Tsegaye Seyoum
(74) *Attorney, Agent, or Firm* — Greenblum & Bernstein, P.L.C.

(57) ABSTRACT

Any of first and second sub-field configurations is selected. In the first sub-field configuration, a width of a write pulse of a sub-field with a lowest display luminance is not more than widths of write pulses of the other sub-fields. In the second sub-field configuration, the width of the write pulse of the sub-field with the lowest display luminance is larger than the widths of the write pulses of the other sub-fields. When the first sub-field configuration is selected, a voltage applied to a sustain electrode in a write period of the sub-field with the lowest display luminance is set higher than a voltage applied to the sustain electrode in write periods of the other sub-fields. When the second sub-field configuration is selected, the voltage applied to the sustain electrode in the write period of the sub-field with the lowest display luminance is set to be the same as the voltage applied to the sustain electrode in the write period of any of the other sub-fields.

15 Claims, 6 Drawing Sheets

U.S. PATENT DOCUMENTS

| | | | |
|---|---|---|---|
| 2003/0122494 | A1 | 7/2003 | Ide |
| 2004/0207573 | A1 | 10/2004 | Ide |
| 2004/0212565 | A1 | 10/2004 | Ide |
| 2006/0097964 | A1 | 5/2006 | Moon |
| 2006/0232507 | A1 | 10/2006 | Myoung et al. |
| 2007/0188416 | A1 | 8/2007 | Inoue |
| 2007/0195051 | A1 | 8/2007 | Ikeda |
| 2007/0205964 | A1 | 9/2007 | Nagaki |
| 2007/0268216 | A1 | 11/2007 | Arai et al. |

FOREIGN PATENT DOCUMENTS

| | | |
|---|---|---|
| JP | 2001-228821 | 8/2001 |
| JP | 2002-14652 | 1/2002 |
| JP | 2003-177695 | 6/2003 |
| JP | 2003-337565 | 11/2003 |
| JP | 2003-346666 | 12/2003 |
| JP | 2006-139285 | 6/2006 |
| JP | 2006-215495 | 8/2006 |
| JP | 2006-301583 | 11/2006 |
| KR | 2005-0113841 | 12/2005 |
| KR | 10-0739060 | 5/2006 |

OTHER PUBLICATIONS

English language Abstract of JP 2003-337565.
English language Abstract of JP 2006-139285.
English language Abstract of JP 2006-301583.
English language Abstract of JP 2003-346666.
English language Abstract of JP 2006-242224.
English language Abstract of JP 2001-228821.
English language Abstract of JP 2000-14652.
English language Abstract and partial English language translation of KR 10-0739060, May 23, 2006.
English language Abstract and partial English language translation of KR 2005-0113841, Dec. 5, 2005.
English language Abstract of JP 2006-215495, Aug. 17, 2006.

* cited by examiner

DRIVING DEVICE AND DRIVING METHOD OF PLASMA DISPLAY PANEL AND PLASMA DISPLAY DEVICE

TECHNICAL FIELD

The present invention relates to a driving device and a driving method of a plasma display panel and a plasma display device using the same.

BACKGROUND ART

An AC surface discharge type panel that is typical as a plasma display panel (hereinafter abbreviated as "a panel") includes a number of discharge cells between a front plate and a back plate arranged so as to face each other.

The front plate is constituted by a front glass substrate, a plurality of display electrodes, a dielectric layer and a protective layer. Each display electrode is composed of a pair of scan electrode and sustain electrode. The plurality of display electrodes are formed in parallel with one another on the front glass substrate, and the dielectric layer and the protective layer are formed so as to cover the display electrodes.

The back plate is constituted by a back glass substrate, a plurality of data electrodes, a dielectric layer, a plurality of barrier ribs and phosphor layers. The plurality of data electrodes are formed in parallel with one another on the back glass substrate, and the dielectric layer is formed so as to cover the data electrodes. The plurality of barrier ribs are formed in parallel with the data electrodes, respectively, on the dielectric layer, and the phosphor layers of R (red), G (green) and B (blue) are formed on a surface of the dielectric layer and side surfaces of the barrier ribs.

The front plate and the back plate are arranged to face each other such that the display electrodes intersect with the data electrodes in three dimensions, and then sealed. An inside discharge space is filled with a discharge gas. The discharge cells are formed at respective portions at which the display electrodes and the data electrodes face each other.

In the panel having such a configuration, a gas discharge generates ultraviolet rays, which cause phosphors of R, G and B to be excited and to emit light in each of the discharge cells. Accordingly, color display is performed.

A sub-field method is employed as a method for driving the panel. In the sub-field method, one field period is divided into a plurality of sub-fields, and the discharge cells are caused to emit light or not in the respective sub-fields, so that a gray scale display is performed. Each of the sub-fields has a setup period, a write period and a sustain period.

In the setup period, a setup discharge is performed, and wall charges that are required for a subsequent write operation is formed in each discharge cell. In addition, the setup period has a function of generating priming for reducing a discharge time lag to stably generate a write discharge. Here, the priming means an excited particle that serves as an initiating agent for the discharge.

In the write period, progressive-scan pulses are applied to the scan electrodes while write pulses corresponding to image signals to be displayed are applied to the data electrodes. This selectively generates the write discharges between the scan electrodes and the data electrodes, causing the wall charges to be selectively formed.

In a subsequent sustain period, the sustain pulses are applied between the scan electrodes and the sustain electrodes a predetermined number of times corresponding to luminances to be displayed. Accordingly, discharges are selectively induced in the discharge cells in which the wall charges have been formed by the write discharges, causing the discharge cells to emit light. Hereinafter, a ratio of a display luminance of each sub-field to a reference display luminance is referred to as "a luminance weight".

Patent Document 1 discloses new driving methods, which are employed in the foregoing sub-field method, such as a method for performing the setup discharge by using a voltage waveform that gradually varies for suppressing light emission that is not involved in a gray scale display to the minimum to improve a contrast ratio and a method for selectively performing the setup discharges in the discharge cells in which sustain discharges have been performed.

In addition, Patent Document 2 discloses a driving method of the panel in which erroneous discharges are suppressed by providing a pseudo-sub-field period between the last sub-field of a field period and the first sub-field of the next field period and generating a weak discharge in this pseudo-sub-field period.

Furthermore, Patent Document 3 discloses a driving method of the panel in which halftones closer to black can be displayed by providing a sub-field for performing a gray scale display by using pulses having wide portions.

[Patent Document 1] JP 2000-242224 A
[Patent Document 2] JP 2001-228821 A
[Patent Document 3] JP 2002-14652 A

DISCLOSURE OF THE INVENTION

Problems to be Solved by the Invention

It is considered that a driving method of a panel capable of displaying halftones having a high contrast while being closer to black can be achieved by combining the above-mentioned driving methods.

However, reducing an emission intensity of a setup discharge that is not involved in a gray scale display tends to weaken an effect of priming. This is liable to cause a discharge cell that does not emit light (hereinafter abbreviated as "a turned-off cell") at the time of displaying a low gray level, even though a write pulse is applied. Specifically, when discharge cells around the discharge cell that should emit light do not emit light, causing the discharge cell that should emit light to be isolated as in a sub-field subjected to an error diffusion processing, the discharge cell that should emit light tends to be a turned-off cell.

An object of the present invention is to provide a driving device and a driving method of a high-image-display-quality plasma display panel, in which such a phenomenon that the discharge cell that should light up does not light up is unlikely to occur even in case of displaying a low gray level and halftones closer to black can be displayed, and a plasma display device using the same.

Means for Solving the Problems (1)

According to an aspect of the present invention, a driving device that drives a plasma display panel including a plurality of discharge cells at intersections of a scan electrode and a sustain electrode with a plurality of data electrodes by a sub-field method where one field period includes a plurality of sub-fields includes a driving circuit that generates a write discharge by selectively applying a write pulse to the plurality of discharge cells in a write period of each of the sub-fields and causes the discharge cell in which the write discharge has been generated to emit light with a predetermined display luminance in a sustain period, a selection unit that selects any of a first sub-field configuration where a width of the write pulse in a sub-field with a lowest display luminance is not more than widths of the write pulses in other sub-fields and a second sub-field configuration where the width of the write pulse in the sub-field with the lowest display luminance is larger than the widths of the write pulses in the other sub-fields, and a voltage setting circuit that sets a voltage applied to the sustain electrode in the write period of the sub-field with the lowest display luminance higher than a voltage applied to the sustain electrode in the write periods of the other sub-fields when the first sub-field configuration is selected by the selection unit and sets the voltage applied to the sustain electrode in the write period of the sub-field with the lowest display luminance to be the same as the voltage applied to the sustain electrode in the write period of any of the other sub-fields when the second sub-field configuration is selected by the selection unit.

In the driving device, the write pulse is selectively applied to the plurality of discharge cells in the write period of each of the sub-fields by the driving circuit, so that the write discharge is generated. The discharge cell in which the write discharge has been generated emits light with the predetermined display luminance in the sustain period.

The selection unit selects any of the first sub-field configuration and the second sub-field configuration.

In the first sub-field configuration, the width of the write pulse in the sub-field with the lowest display luminance is not more than the widths of the write pulses in the other sub-fields. In this case, an image with emphasized luminance and contrast can be displayed while a standard image can be displayed.

In the second sub-field configuration, the width of the write pulse in the sub-field with the lowest display luminance is larger than the widths of the write pulses in the other sub-fields. In this case, halftones closer to black can be displayed.

When the first sub-field configuration is selected, the voltage applied to the sustain electrode in the write period of the sub-field with the lowest display luminance is set higher than the voltage applied to the sustain electrode in the write periods of the other sub-fields by the voltage setting circuit. Accordingly, the write discharge is reliably generated in the discharge cell that should light up even in a case where an adjacent discharge cell does not light up. This suppresses generation of such a phenomenon that the discharge cell that should light up does not light up, and improves image display quality. At this time, although there is a possibility that an erroneous lighting in which a discharge cell that should not light up erroneously lights up is generated in a region that displays an image with a high gray level, such a region has a high luminance. Therefore, it is hard to visually recognize the erroneous lighting in the sub-field with the smallest luminance weight, and deterioration in picture quality caused by the erroneous lighting is substantially not generated.

When the second sub-field configuration is selected, the voltage applied to the sustain electrode in the write period of the sub-field with the lowest display luminance is set to be the same as the voltage applied to the sustain electrode in the write period of any of the other sub-fields by the voltage setting circuit. Thus, halftones closer to black can be displayed without generation of the erroneous lighting.

As described above, such a phenomenon that the discharge cell that should light up does not light up is unlikely to be caused even in a case where a low gray level is displayed while halftones closer to black can be displayed. As a result, high image display quality can be obtained.

(2)

The sub-field with the lowest display luminance in the first sub-field configuration may be a sub-field that includes a setup period in which setup discharges are performed in all of the plurality of discharge cells.

In this case, a sufficient effect of priming can be obtained in the setup period of the sub-field with the lowest display luminance. Thus, generation of the phenomenon in which the discharge cell that should light up does not light up when a low gray level is displayed can be sufficiently suppressed.

(3)

A sub-field following the sub-field with the lowest display luminance in the second sub-field configuration may be a sub-field that includes a setup period in which setup discharges are performed in all of the plurality of discharge cells.

In this case, a discharge time lag caused by shortage of the priming can be suppressed in the sub-field with the lowest display luminance since the width of the write pulse in the sub-field with the lowest display luminance is larger than the widths of the write pulses in the other sub-fields. In addition, the voltage applied to the sustain electrode in the write period of the sub-field with the lowest display luminance is set to be the same as the voltage applied to the sustain electrode in the write period of any of the other sub-fields. This prevents the discharge cell that should not light up from erroneously lighting up even though the width of the write pulse is large.

(4)

The sub-field with the lowest display luminance in the second sub-field configuration may be a sub-field that does not include a setup period in which setup discharges are performed in part or all of the plurality of discharge cells.

In this case, the sub-field with the lowest display luminance does not include the setup period in which the setup discharge is performed, so that a driving time is shortened.

(5)

The sub-field with the lowest display luminance in the second sub-field configuration may be a sub-field for causing the discharge cell in which the write discharge has been generated to emit light by using a pulse with a larger width than widths of pulses of the other sub-fields.

In this case, it is possible to reliably cause the discharge cell in which the write discharge has been generated to emit light in the sub-field with the lowest display luminance.

(6)

The voltage setting circuit may include a first node that receives a first voltage, a second node that receives a second voltage, a third node that receives a third voltage that is higher than the second voltage, an addition circuit that adds the second voltage of the second node or the third voltage of the third node to the first voltage of the first node, and a first switching circuit that provides a voltage obtained by the addition circuit to the sustain electrode in the write period of each of the sub-fields, wherein the addition circuit may add, when the first sub-field configuration is selected by the selection unit, the third voltage of the third node to the first voltage of the first node in the write period of the sub-field with the lowest display luminance and add the second voltage of the second node to the first voltage of the first node in the write periods of the other sub-fields, and add, when the second sub-field configuration is selected by the selection unit, the second voltage of the second node to the first voltage of the first node in the write periods of the sub-field with the lowest display luminance and any of the other sub-fields.

In this case, when the first sub-field configuration is selected, the third voltage of the third node is added to the first voltage of the first node in the write period of the sub-field with the lowest display luminance, and the second voltage of the second node is added to the first voltage of the first node in the write periods of the other sub-fields. Accordingly, the voltage applied to the sustain electrode in the write period of the sub-field with the lowest display luminance is set higher than the voltage applied to the sustain electrode in the write periods of the other sub-fields.

In this way, the voltages applied to the sustain electrode can be switched by a simple configuration in the first sub-field configuration and the second sub-field configuration.

(7)

The first switching circuit may be connected between the first node and the sustain electrode, and the addition circuit may include a capacitance connected between the first node and a fourth node, a second switching circuit connected between the second node and the fourth node, and a third switching circuit connected between the third node and the fourth node.

In this case, the second voltage and the third voltage can be selectively applied to the capacitance by the second switching circuit and the third switching circuit. Thus, the second voltage and the third voltage can be selectively added to the first voltage by the simple configuration.

(8)

The first switching circuit may include an n-channel switching device and a p-channel switching device connected in series between the first node and the sustain electrode.

In this case, the voltage applied to the sustain electrode can be switched at a predetermined timing by the simple configuration. Moreover, a current is prevented from flowing from the sustain electrode to the first node even in a case where the n-channel switching device and the p-channel switching device include parasitic diodes.

(9)

The second switching circuit may include a switching device connected in series between the second node and the fourth node.

In this case, the second voltage of the second node can be applied to the fourth node at a predetermined timing by the simple configuration.

(10)

The third switching circuit may include an n-channel switching device and a p-channel switching device connected in series between the third node and the fourth node.

In this case, the third voltage of the third node can be applied to the fourth node at a predetermined timing by the simple configuration. In addition, the current is prevented from flowing from the fourth node to the third node even in a case where the n-channel switching device and the p-channel switching device include parasitic diodes.

(11)

The addition circuit may further include a switching device connected in series between the fourth node and a ground terminal.

In this case, the simple configuration allows the fourth node to be at a ground potential.

(12)

According to another aspect of the present invention, a driving method of a plasma display panel includes a plurality of discharge cells at intersections of a scan electrode and a sustain electrode with a plurality of data electrodes, wherein one field period includes a plurality of sub-fields each including a write period for generating a write discharge by selectively applying a write pulse to the plurality of discharge cells and a sustain period for causing the discharge cell in which the write discharge has been generated to emit light with a predetermined display luminance, and the plurality of sub-fields include any of a first sub-field configuration where a width of the write pulse in a sub-field with a lowest display luminance is not more than widths of the write pulses in other sub-fields and a second sub-field configuration where the width of the write pulse in the sub-field with the lowest display luminance is larger than the widths of the write pulses in the other sub-fields, the driving method of the plasma display panel including the steps of selecting any of the first sub-field configuration and the second sub-field configuration, setting a voltage applied to the sustain electrode in the write period of the sub-field with the lowest display luminance higher than a voltage applied to the sustain electrode in the write periods of the other sub-fields when the first sub-field configuration is selected and setting the voltage applied to the sustain electrode in the write period of the sub-field with the lowest display luminance to be the same as the voltage applied to the sustain electrode in the write period of any of the other sub-fields when the second sub-field configuration is selected.

In the driving method, the write pulse is selectively applied to the plurality of discharge cells in the write period of each sub-field, so that the write discharge is generated. The discharge cell in which the write discharge has been generated emits light with a predetermined display luminance in the sustain period.

Any of the first sub-field configuration and the second sub-field configuration is selected.

In the first sub-field configuration, the width of the write pulse in the sub-field with the lowest display luminance is not more than the widths of the write pulses in the other sub-fields. In this case, an image with emphasized luminance and contrast can be displayed while a standard image can be displayed.

In the second sub-field configuration, the width of the write pulse in the sub-field with the lowest display luminance is larger than the widths of the write pulses in the other sub-fields. In this case, halftones closer to black can be displayed.

When the first sub-field configuration is selected, the voltage applied to the sustain electrode in the write period of the sub-field with the lowest display luminance is set higher than the voltage applied to the sustain electrode in the write periods of the other sub-fields. Accordingly, the write discharge is reliably generated in the discharge cell that should light up even in a case where an adjacent discharge cell does not light up. This suppresses generation of such a phenomenon that the discharge cell that should light up does not light up, and improves image display quality. At this time, although there is a possibility that an erroneous lighting in which a discharge cell that should not light up erroneously lights up is generated in a region that displays an image with a high gray level, such a region has a high luminance. Therefore, it is hard to visually recognize the erroneous lighting in the sub-field with the smallest luminance weight, and deterioration in picture quality caused by the erroneous lighting is substantially not generated.

When the second sub-field configuration is selected, the voltage applied to the sustain electrode in the write period of the sub-field with the lowest display luminance is set to be the same as the voltage applied to the sustain electrode in the write period of any of the other sub-fields. Thus, halftones closer to black can be displayed without generation of the erroneous lighting.

As described above, such a phenomenon that the discharge cell that should light up does not light up is unlikely to be caused even in a case where a low gray level is displayed while halftones closer to black can be displayed. As a result, high image display quality can be obtained.

(13)

The sub-field with the lowest display luminance in the first sub-field configuration may be a sub-field that includes a setup period in which setup discharges are performed in all of the plurality of discharge cells.

In this case, a sufficient effect of priming can be obtained in the setup period of the sub-field with the lowest display luminance. Thus, generation of the phenomenon in which the discharge cell that should light up does not light up when a low gray level is displayed can be sufficiently suppressed.

(14)

A sub-field following the sub-field with the lowest display luminance in the second sub-field configuration may be a sub-field that includes a setup period in which setup discharges are performed in all of the plurality of discharge cells.

In this case, a discharge time lag caused by shortage of the priming is suppressed in the sub-field with the lowest display luminance since the width of the write pulse in the sub-field with the lowest display luminance is larger than the widths of the write pulses in the other sub-fields. In addition, the voltage applied to the sustain electrode in the write period of the sub-field with the lowest display luminance is set to be the same as the voltage applied to the sustain electrode in the write period of any of the other sub-fields. This prevents the discharge cell that should not light up from erroneously lighting up even though the width of the write pulse is large.

(15)

The sub-field with the lowest display luminance in the second sub-field configuration may be a sub-field that does not include a setup period in which setup discharges are performed in part or all of the plurality of discharge cells.

In this case, the sub-field with the lowest display luminance does not include the setup period in which the setup discharge is performed, so that a driving time is shortened.

(16)

The sub-field with the lowest display luminance in the second sub-field configuration may be a sub-field for causing the discharge cell in which the write discharge has been generated to emit light by using a pulse with a larger width than widths of pulses of the other sub-fields.

In this case, it is possible to reliably cause the discharge cell in which the write discharge has been generated to emit light in the sub-field with the lowest display luminance.

(17)

According to still another aspect of the present invention, a plasma display device includes a plasma display panel including a plurality of discharge cells at intersections of a scan electrode and a sustain electrode with a plurality of data electrodes, a driving circuit that drives the plasma display panel by a sub-field method where one field period includes a plurality of sub-fields, generates a write discharge by selectively applying a write pulse to the plurality of discharge cells in a write period of each of the sub-fields and causes the discharge cell in which the write discharge has been generated to emit light with a predetermined display luminance in a sustain period, a selection unit that selects any of a first sub-field configuration where a width of the write pulse in a sub-field with a lowest display luminance is not more than widths of the write pulses in other sub-fields and a second sub-field configuration where the width of the write pulse in the sub-field with the lowest display luminance is larger than the widths of the write pulses in the other sub-fields, and a voltage setting circuit that sets a voltage applied to the sustain electrode in the write period of the sub-field with the lowest display luminance higher than a voltage applied to the sustain electrode in the write periods of the other sub-fields when the first sub-field configuration is selected by the selection unit and sets the voltage applied to the sustain electrode in the write period of the sub-field with the lowest display luminance to be the same as the voltage applied to the sustain electrode in the write period of any of the other sub-fields when the second sub-field configuration is selected by the selection unit.

In the plasma display device, the driving circuit drives the plasma display panel by the sub-field method and the write pulse is selectively applied to the plurality of discharge cells in the write period of each sub-field, so that the write discharge is generated. The discharge cell in which the write discharge has been generated emits light with a predetermined display luminance in the sustain period.

The selection unit selects any of the first sub-field configuration and the second sub-field configuration.

In the first sub-field configuration, the width of the write pulse in the sub-field with the lowest display luminance is not more than the widths of the write pulses in the other sub-fields. In this case, an image with emphasized luminance and contrast can be displayed while a standard image can be displayed.

In the second sub-field configuration, the width of the write pulse in the sub-field with the lowest display luminance is larger than the widths of the write pulses in the other sub-fields.

In this case, halftones closer to black can be displayed.

When the first sub-field configuration is selected, the voltage applied to the sustain electrode in the write period of the sub-field with the lowest display luminance is set higher than the voltage applied to the sustain electrode in the write periods of the other sub-fields by the voltage setting circuit. Accordingly, the write discharge is reliably generated in the discharge cell that should light up even in a case where an adjacent discharge cell does not light up. This suppresses generation of such a phenomenon that the discharge cell that should light up does not light up, and improves image display quality. At this time, although there is a possibility that an erroneous lighting in which a discharge cell that should not light up erroneously lights up is generated in a region that displays an image with a high gray level, such a region has a high luminance. Therefore, it is hard to visually recognize the erroneous lighting in the sub-field with the smallest luminance weight, and deterioration in picture quality caused by the erroneous lighting is substantially not generated.

When the second sub-field configuration is selected, the voltage applied to the sustain electrode in the write period of the sub-field with the lowest display luminance is set to be the same as the voltage applied to the sustain electrode in the write period of any of the other sub-fields by the voltage setting circuit. Thus, halftones closer to black can be displayed without generation of the erroneous lighting.

As described above, such a phenomenon that the discharge cell that should light up does not light up is unlikely to be caused even in a case where a low gray level is displayed while halftones closer to black can be displayed. As a result, high image display quality can be obtained.

Effects of the Invention

According to the present invention, such a phenomenon that a discharge cell that should light up does not light up is unlikely to occur even in a case where a low gray level is displayed, and halftones closer to black can be displayed. As a result, high image display quality can be obtained.

BEST MODE FOR CARRYING OUT THE INVENTION

Figure 1:
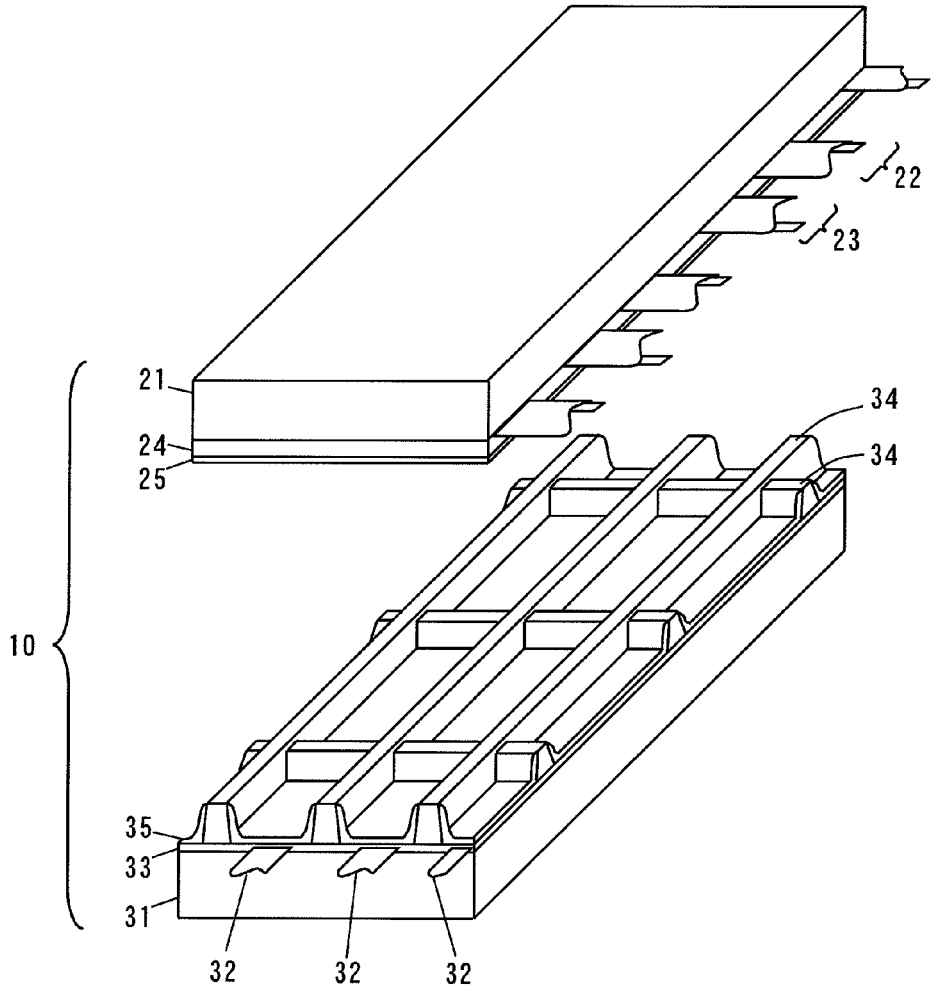
FIG. 1 is an exploded perspective view showing part of a plasma display panel in a plasma display device according to an embodiment of the present invention.

The embodiment of the present invention will be described in detail referring to the drawings. The embodiment below describes a plasma display device.

(1) Configuration of Panel

FIG. 1 is an exploded perspective view showing part of a plasma display panel in a plasma display device according to the embodiment of the present invention.

The plasma display panel (hereinafter abbreviated as the panel) 10 includes a front substrate 21 and a back substrate 31 that are made of glasses and arranged so as to face each other. A discharge space is formed between the front substrate 21 and the back substrate 31. A plurality of pairs of scan electrodes 22 and sustain electrodes 23 are formed in parallel with one another on the front substrate 21. Each pair of scan electrode 22 and sustain electrode 23 constitutes a display electrode. A dielectric layer 24 is formed so as to cover the scan electrodes 22 and the sustain electrodes 23, and a protective layer 25 is formed on the dielectric layer 24.

A plurality of data electrodes 32 covered with an insulator layer 33 are provided on the back substrate 31, and barrier ribs 34 are provided in a shape of a number sign on the insulator layer 33. Phosphor layers 35 are provided on a surface of the insulator layer 33 and side surfaces of the barrier ribs. Then, the front substrate 21 and the back substrate 31 are arranged to face each other such that the plurality of pairs of scan electrodes 22 and sustain electrodes 23 vertically intersect with the plurality of data electrodes 32, and the discharge space is formed between the front substrate 21 and the back substrate 31. The discharge space is filled with a mixed gas of neon and xenon, for example, as a discharge gas. Note that the configuration of the panel is not limited to the configuration described in the foregoing. A configuration including the barrier ribs in a striped shape may be employed, for example.

Figure 2:
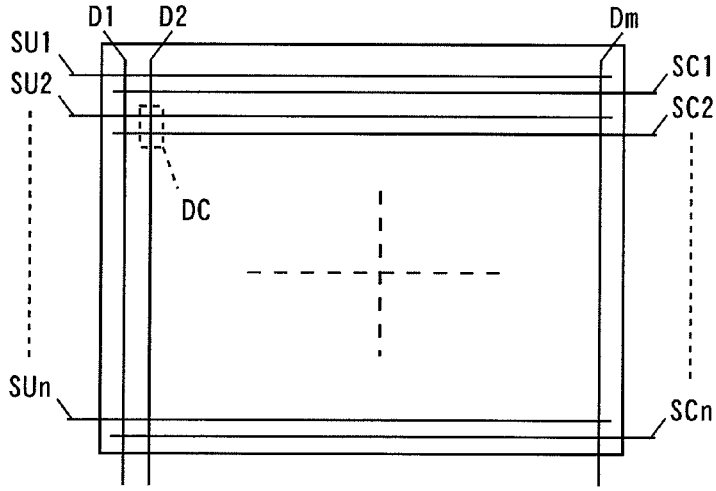
FIG. 2 is a diagram showing an arrangement of electrodes in the plasma display panel of FIG. 1.

FIG. 2 is a diagram showing an arrangement of electrodes of the panel in the embodiment of the present invention. N scan electrodes SC1 to SCn (the scan electrodes 22 of FIG. 1) and n sustain electrodes SU1 to SUn (the sustain electrodes 23 of FIG. 1) are arranged along a row direction, and m data electrodes D1 to Dm (the data electrodes 32 of FIG. 1) are arranged along a column direction. N and m are natural numbers of not less than two, respectively. Then, a discharge cell DC is formed at an intersection of a pair of scan electrode SCi (i=1 to n) and sustain electrode SUi (i=1 to n) with one data electrodes Dj (j=1 to m). Accordingly, m×n discharge cells are formed in the discharge space.

(2) Configuration of the Plasma Display Device

Figure 3:
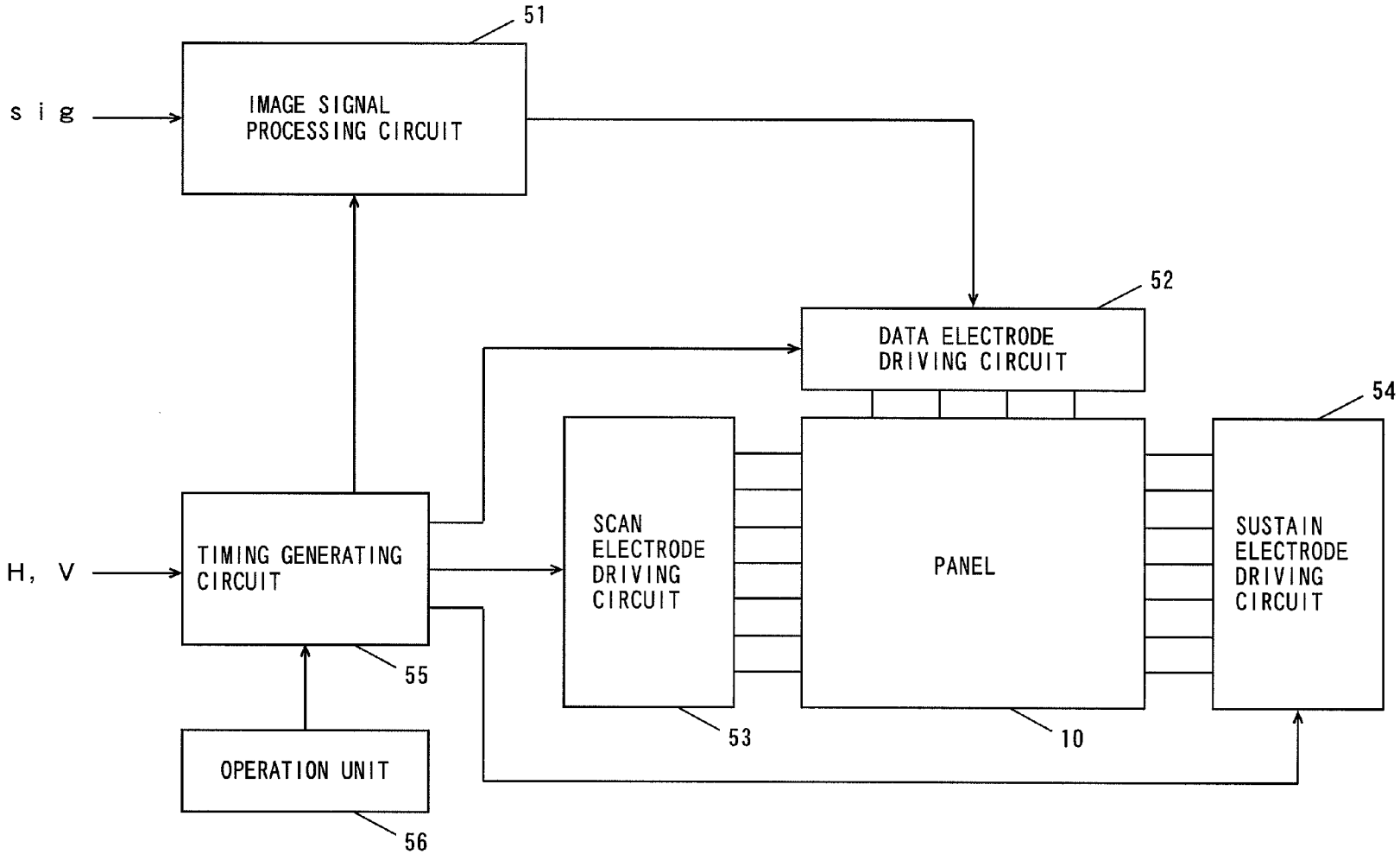
FIG. 3 is a block diagram of circuits in the plasma display device according to the embodiment of the present invention.

FIG. 3 is a circuit block diagram of the plasma display device according to the embodiment of the present invention.

This plasma display device includes the panel 10, an image signal processing circuit 51, a data electrode driving circuit 52, a scan electrode driving circuit 53, a sustain electrode driving circuit 54, a timing generating circuit 55, an operation unit 56 and a power supply circuit (not shown).

The image signal processing circuit 51 converts an image signal sig into image data corresponding to the number of pixels of the panel 10, divides the image data on each pixel into a plurality of bits corresponding to a plurality of sub-fields, and outputs them to the data electrode driving circuit 52.

The data electrode driving circuit 52 converts the image data for each sub-field into signals corresponding to the data electrodes D1 to Dm, respectively, and drives the data electrodes D1 to Dm based on the respective signals.

The timing generating circuit 55 generates timing signals based on a horizontal synchronizing signal H and a vertical synchronizing signal V, and supplies the timing signals to each of the driving circuit blocks (the image signal processing circuit 51, the data electrode driving circuit 52, the scan electrode driving circuit 53 and the sustain electrode driving circuit 54).

The scan electrode driving circuit 53 supplies driving waveforms to the scan electrodes SC1 to SCn based on the timing signals, and the sustain electrode driving circuit 54 supplies driving waveforms to the sustain electrodes SU1 to SUn based on the timing signals. The operation unit 56 is composed of a remote controller, for example, and instructs the timing generating circuit 55 to perform operations such as switching of display modes of an image, described later, by an operation of an user.

(3) Sub-Field Configuration

Next, description is made of sub-field configurations in the driving method of the panel according to the embodiment of the present invention.

In the present embodiment, a first sub-field configuration and a second sub-field configuration are switched based on the display mode of the image. The display modes of the image include a dynamic mode, a standard mode, a cinema mode and the like.

In the dynamic mode, strong images with emphasized luminance and contrast are displayed. In the standard mode, standard images are displayed. In the cinema mode, vivid and sophisticated images are displayed by increasing the number of gray levels that can be displayed. These display modes can be switched by using the operation unit 56 in conformity of tastes of users.

The first sub-field configuration is normally employed in the dynamic mode and the standard mode. On the other hand, the second sub-field configuration is employed in the cinema mode, and includes a sub-field in which a gray scale display is performed by using pulses having wide portions. According to the second sub-field configuration, halftones closer to black can be displayed.

The timing generating circuit 55 selects either the first sub-field configuration or the second sub-field configuration based on the display modes set by using the operation unit 56.

Note that the timing generating circuit 55 may switch the first sub-field configuration and the second sub-field configuration based on an APL (Average Picture Level) of the image signals in the dynamic mode or the standard mode.

(4) The First Sub-Field Configuration

First, the first sub-field configuration is explained. In the first sub-field configuration, one field is divided into a plurality of sub-fields on a time base, and luminance weights of the plurality of sub-fields are set such that the luminance weight of each sub-field is not larger than the luminance weight of its succeeding sub-field that is temporally arranged later than each sub-field.

In the present embodiment, one field is divided into ten sub-fields (hereinafter abbreviated as a first SF, a second SF, . . . and a tenth SF) on a time base, and the sub-fields have the luminance weights of 1, 2, 3, 6, 11, 18, 30, 44, 60 and 80, respectively. In this way, the luminance weights of the plurality of sub-fields are set such that the sub-field temporally arranged later has the larger luminance weight. The display luminance is the lowest in the first SF.

In addition, a pseudo-sub-field (hereinafter abbreviated as a pseudo-SF) is provided in a period sandwiched between the tenth SF of each field and the next field.

Figure 4:
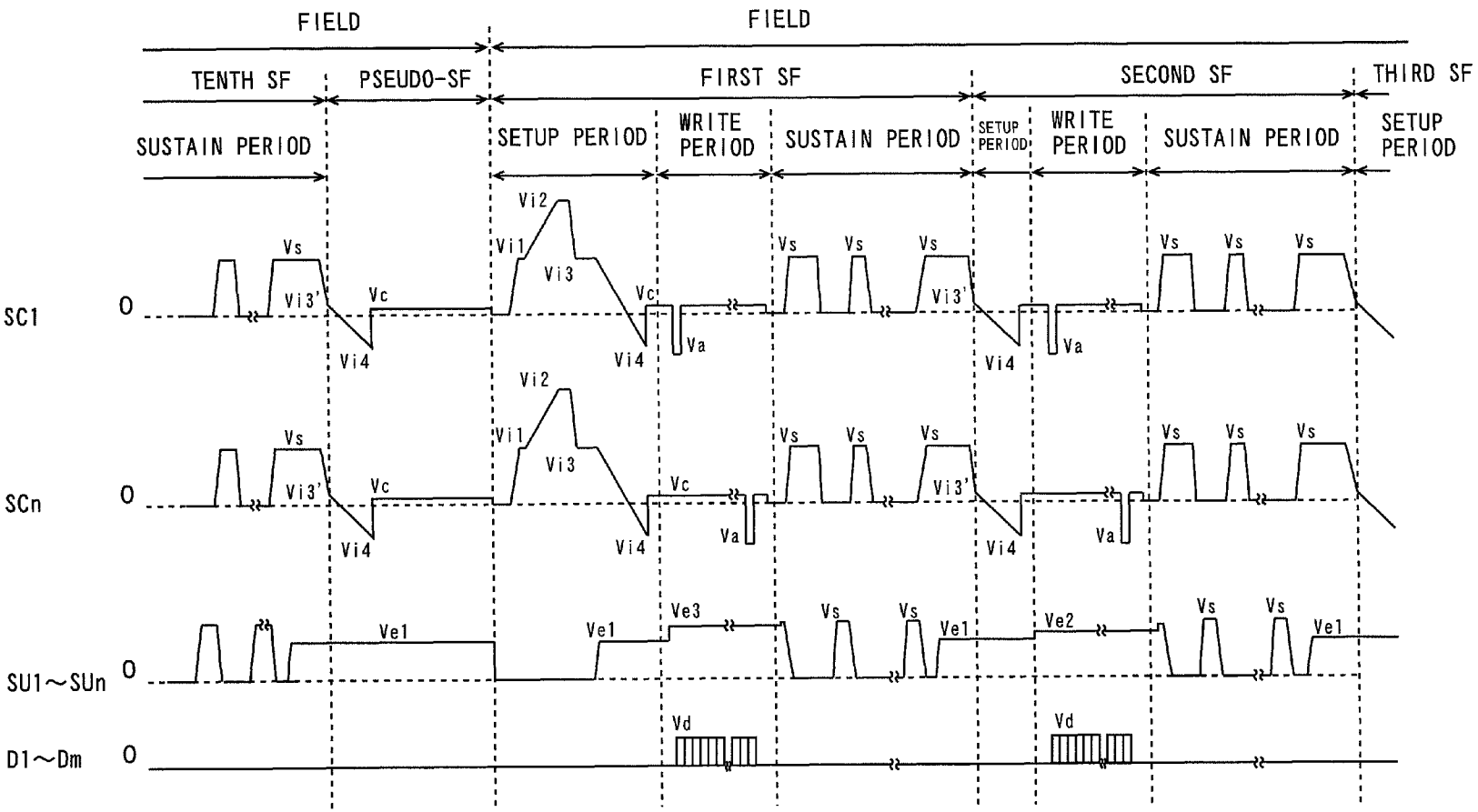
FIG. 4 is a driving voltage waveform diagram in a first sub-field configuration of the plasma display device of FIG. 3.

FIG. 4 is a driving voltage waveform diagram in the first sub-field configuration of the plasma display device of FIG. 3. FIG. 4 shows periods from a sustain period of the tenth SF of a field preceding one field to a setup period of the third SF of a field succeeding the one field.

In the first half of a setup period of the first SF, the data electrodes D1 to Dm and the sustain electrodes SU1 to SUn are held at 0 V (a ground potential), and a ramp voltage is applied to the scan electrodes SC1 to SCn. This ramp voltage gradually rises from a positive voltage Vi1 that is not more than a discharge start voltage toward a positive voltage Vi2 that exceeds the discharge start voltage. Then, first weak setup discharges are induced in all the discharge cells, so that negative wall charges are stored on the scan electrodes SC1 to SCn while positive wall charges are stored on the sustain electrodes SU1 to SUn and the data electrodes D1 to Dm, respectively. Here, a voltage caused by wall charges stored on the dielectric layer, the phosphor layer or the like covering the electrode is referred to as a wall voltage on the electrode.

In the subsequent second half of the setup period, the sustain electrodes SU1 to SUn are kept at a positive voltage Ve1, and the lamp voltage that gradually drops from a positive voltage Vi3 toward a negative voltage Vi4 is applied to the scan electrodes SC1 to SCn. Then, second weak setup discharges are induced in all the discharge cells, so that the wall voltage on the scan electrodes SC1 to SCn and the wall voltage on the sustain electrodes SU1 to SUn are weakened, and the wall voltage on the data electrodes D1 to Dm are adjusted to a value suitable for a write operation. As described above, a setup operation for all the cells that generates the setup discharges in all the discharge cells is performed in the setup period of the first SF.

In a write period of the first SF with the lowest display luminance, a voltage Ve3 is applied to the sustain electrodes SU1 to SUn, and the scan electrodes SC1 to SCn are temporarily held at a voltage Vc. Next, a positive write pulse voltage Vd is applied to a data electrode Dk (k is any of 1 to m), among the data electrodes D1 to Dm, of the discharge cell that should emit light on a first line while a negative scan pulse voltage Va is applied to the scan electrode SC1 on the first line. Then, a voltage at an intersection of the data electrode Dk and the scan electrode SC1 becomes a value in which the wall voltage on the data electrode Dk and the wall voltage on the scan electrode SC1 are added to an externally applied voltage (Vd-Va), exceeding the discharge start voltage. This generates a write discharge between the data electrode Dk and the scan electrode SC1 and between the sustain electrode SU1 and the scan electrode SC1. As a result, in the discharge cell, the positive wall charges are stored on the scan electrode SC1, the negative wall charges are stored on the sustain electrode SU1 and the negative wall charges are stored on the data electrode Dk. In this way, the write operation in which the write discharge is generated in the discharge cell that should emit light on the first line and the wall charges are stored on each of the electrodes is performed. On the other hand, since a voltage at an intersection of a data electrode Dh (h≠k) to which the write pulse voltage Vd has not been applied and the scan electrode SC1 does not exceed the discharge start voltage, the write discharge is not generated. The above-described write operation is sequentially performed in the discharge cells on the first line to the n-th line, and the write period is then finished.

It should be noted that a value of the voltage Ve3 applied to the sustain electrodes SU1 to SUn is set higher than a value of the voltage Ve1, and specifically, the value of the voltage Ve3 is set higher than a value of a voltage Ve2 described later. Here, the voltage Vet is a voltage applied to the sustain electrodes SU1 to SUn in write periods of sub-fields other than the sub-field with the lowest display luminance. In the present embodiment, the value of the voltage Ve3 is set higher than the value of the voltage Ve2 by about 5 V, and is higher than the value of the voltage Ve1 by about 10 V.

A pulse width of a write pulse in the sub-field with the lowest display luminance is the same as or smaller than pulse widths of write pulses in the other sub-fields. In the present embodiment, the pulse width of the write pulse in the first SF is set to 1.7 μs, which also applies to the pulse widths of the write pulses in the following second SF to tenth SF.

Likewise, a pulse width of a scan pulse in the sub-field with the lowest display luminance is the same as or smaller than pulse widths of scan pulses in the other sub-fields. Similarly in the pulse widths of the scan pulses, the pulse width of the scan pulse in the first SF is set to be the same as the pulse widths of the scan pulses in the following second SF to tenth SF in the present embodiment.

In a subsequent sustain period, the sustain electrodes SU1 to SUn are returned to 0 V, and a sustain pulse voltage Vs is applied to the scan electrodes SC1 to SCn for the first time in the sustain period. At this time, in the discharge cell in which the write discharge has been generated in the write period, a voltage between the scan electrode SCi and the sustain electrode SUi becomes a value in which the wall voltage on the scan electrode SCi and the wall voltage on the sustain electrode SUi are added to the sustain pulse voltage Vs, exceeding the discharge start voltage. This induces a sustain discharge between the scan electrode SCi and the sustain electrode SUi, causing the discharge cell to emit light. As a result, the negative wall charges are stored on the scan electrode SCi, the positive wall charges are stored on the sustain electrode SUi, and the positive wall charges are stored on the data electrode Dk. In the discharge cell in which the write discharge has not been generated in the write period, the sustain discharge is not induced and the wall charges are held in a state at the end of the setup period. Next, the scan electrodes SC1 to SCn are returned to 0 V, and the sustain pulse voltage Vs is applied to the sustain electrodes SU1 to SUn. Then, since the voltage between the sustain electrode SUi and the scan electrode SCi exceeds the discharge start voltage in the discharge cell in which the sustain discharge has been induced, the sustain discharge is again induced between the sustain electrode SUi and the scan electrode SCi, the negative wall charges are stored on the sustain electrode SUi, and the positive wall charges are stored on the scan electrode SCi. Similarly to this, a predetermined number of sustain pulses are alternately applied to the respective scan electrodes SC1 to SCn and sustain electrodes SU1 to SUn, so that the sustain discharges are continuously performed in the discharge cells in which the write discharges have been generated in the write period. In this way, a sustain operation is finished in the sustain period.

In a setup period of the second SF, the sustain electrodes SU1 to SUn are held at the voltage Ve1, the data electrodes D1 to Dm are held at 0 V, and the lamp voltage that gradually drops from a positive voltage Vi3' toward a negative voltage Vi4 is applied to the scan electrodes SC1 to SCn. Then, weak setup discharges are generated in the discharge cells in which the sustain discharges have been induced in the sustain period of the preceding sub-field. Accordingly, the wall voltage on the scan electrodes SCi and the wall voltage on the sustain electrodes SUi are weakened, and the wall voltage on the data electrode Dk is adjusted to a value suitable for a write operation.

Meanwhile, the discharges are not generated and the wall charges are kept constant in a state at the end of the setup period of the preceding sub-field in the discharge cells in which the write discharges and the sustain discharges have not been induced in the preceding sub-field.

As described above, a selective setup operation that selectively generates the setup discharges in the discharge cells in which the sustain discharges have been induced in the immediately preceding sub-field is performed in the setup period of the second SF.

In a write period of the second SF, the voltage Ve2 is applied to the sustain electrodes SU1 to SUn, and the scan electrodes SC1 to SCn are held at the voltage Vc. Next, the write pulse voltage Vd is applied to the data electrode Dk, among the data electrodes D1 to Dm, in the discharge cell that should emit light on the first line while the scan pulse voltage Va is applied to the scan electrode SC1 on the first line, so that the write operation is performed. The above-described write operation is sequentially performed in the discharge cells on the first line to the n-th line, and the write period is then finished.

The value of the voltage Ve2 applied here is set lower than the value of the voltage Ve3. As described above, the value of the voltage Ve2 is set lower than the value of the voltage Ve3 by about 5 V in the present embodiment.

Since an operation in a subsequent sustain period is the same as the operation in the sustain period of the first SF except for the number of the sustain pulses, explanation is omitted.

In the setup periods in the following third SF to tenth SF, the selective setup operations are performed similarly to the setup period of the second SF. In the write periods of the third SF to tenth SF, the voltage Ve2 is applied to the sustain electrodes SU1 to SUn similarly to the case in the second SF, so that the write operations are performed. In the sustain periods of the third SF to tenth SF, the sustain operations that are the same as that in the sustain period of the first SF except for the number of the sustain pulses are performed.

In the pseudo-sub-field at the end of one field, the voltage Ve1 is applied to the sustain electrodes SU1 to SUn, the data electrodes D1 to Dm are kept at 0 V, the lamp voltage that gradually drops from the positive voltage Vi3' toward the negative voltage Vi4 is applied to the scan electrodes SC1 to SCn similarly to the setup period of the second SF. Then, weak setup discharges are generated in the discharge cells in which the sustain discharges have been induced in the sustain period of the preceding sub-field similarly to the setup period of the second SF. Thereafter, a constant voltage is applied to each of the electrodes. In the present embodiment, the voltage Vc is applied to the scan electrodes SC1 to SCn, the voltage Ve1 is applied to the sustain electrodes SU1 to SUn, and the data electrodes D1 to Dm are kept at 0 V.

Next, description is made of the reason why the voltage Ve3 applied to the sustain electrodes in the write period of the first SF with the lowest display luminance is set higher than the voltage Ve2 applied to the sustain electrodes in the write periods of the other sub-fields in the first sub-field configuration.

As described above, the luminance weight of each sub-field is set so as not to be larger than the luminance weight of its succeeding sub-field that is temporally arranged later than each sub-field. In the present embodiment, the luminance weights of the plurality of sub-fields are set such that the sub-field temporally arranged later has the larger luminance weight.

Here, the luminance weight of the first SF is "1". Therefore, the first SF has the lowest display luminance, and displays an image in which a difference in gray levels is the smallest. Thus, the discharge cells that should light up (hereinafter abbreviated as "lighting cells") and the discharge cells that should not light up (hereinafter abbreviated as "non-lighting cells") tend to be randomly mixed with one another in the first SF. In such a case, there is a high probability that the lighting cells and the non-lighting cells are adjacent to one another. Hereinafter, the lighting cells adjacent to the non-lighting cells are referred to as "isolated lighting cells". In addition, when error diffusion processing or dither diffusion processing is performed, the lighting cells and the non-lighting cells in the first SF are randomly or regularly mixed with one another, so that the probability that the lighting cells become the isolated lighting cells further increases.

In the write operation of such isolated lighting cells, priming caused by the write discharges cannot be obtained from discharge cells adjacent thereto since there exists no lighting cells in which the write operations have been performed immediately before in their surroundings. Thus, a discharge time lag of the isolated lighting cells becomes large in the conventional driving method. As a result, the sustain discharges in the subsequent sustain period or the write discharges themselves are not generated in the isolated lighting cells because of the insufficient wall charges stored during the write discharges, so that the isolated lighting cells become turned-off cells in some cases.

Contrary to this, in the present embodiment, the write discharges are more easily generated since the voltage Ve3 applied to the sustain electrodes in the write period of the first SF is set high. This can reliably generate the write discharges in the isolated lighting cells and prevent the isolated lighting cells from being the turned-off cells.

Meanwhile, when the voltage Ve3 applied to the sustain electrodes is set high, the write discharges are easily generated. Thus, there has been a concern that the write discharges are induced in the discharge cells that should not emit light, resulting in an increase of the discharge cells that erroneously emit light (hereinafter abbreviated as "erroneous lighting cells") in the sustain period. As a result of detailed examination by the inventors, however, it was found that such an erroneous lighting is generated only in the lighting cells with excessive priming.

Specifically, discharge cells that have lighted up in the tenth SF easily become the erroneous lighting cells in the first SF. The probability that the discharge cells that have lighted up in the ninth SF and have not lighted up in the tenth SF become the erroneous lighting cells in the first SF is decreased. The probability that the discharge cells that have lighted up in the eighth SF and have not lighted up in the ninth SF and the tenth SF become the erroneous lighting cells in the first SF is significantly decreased. The discharge cells that have lighted up in the fifth SF and have not light up in the sixth SF to the tenth SF do not become the erroneous lighting cell in the first SF.

The reason for this is considered as follows. In the tenth SF, its luminance weight is "80" which is the largest, and a large amount of priming is generated within the discharge cells in which the sustain discharges have been induced. The write operation is then started in the first SF before the priming is attenuated. Therefore, the write discharges are easily generated by setting the voltage Ve3 applied to the sustain electrodes high, so that the write discharges are induced in the discharge cells to which the write pulses are not applied, and the erroneous cells are generated. On the other hand, the discharge cells that have lighted up in the fifth SF and have not lighted up in the sixth SF to the tenth SF do not become the erroneous discharge cells because of the comparatively small luminance weight of "11" of the fifth SF and enough time interval, which substantially attenuates the priming, from the sustain period of the fifth SF to the write period of the first SF.

As described above, it was found that although there is a possibility that the erroneous discharge cells are generated by setting the high voltage Ve3 applied to the sustain electrodes in the write period of the first SF, such erroneous discharge cells are generated only in the discharge cells that display high gray levels. Meanwhile, brightness that a human perceives has a logarithmic relation with respect to luminance as is well known. Thus, even though generation of the erroneous lighting cells slightly increases the luminance in a region that displays high luminance, a human hardly perceives change in brightness.

As described above, the voltage Ve3 applied to the sustain electrodes in the write period of the first SF is set high, so that the write discharges are reliably generated even in the isolated lighting cells in the first sub-field configuration. This suppresses generation of the turned-off cells and improves image display quality. Here, although there is a possibility that the erroneous discharge cells are generated in a region that displays an image with a high gray level, such a region has the high luminance. Therefore, it is hard to visually recognize the erroneous lighting cells in the first SF with the smallest luminance weight, and deterioration in picture quality caused by the erroneous lighting cells is substantially not generated.

(5) The Second Sub-Field Configuration

Next, the second sub-field configuration is explained. In the second sub-field configuration, one field is divided into a plurality of sub-fields on a time base, and luminance weights of the plurality of sub-fields are set such that the luminance weight of each sub-field is not larger than the luminance weight of its succeeding sub-field that is temporally arranged later than each sub-field.

In the present embodiment, one field is divided into ten sub-fields (a first SF, a second SF, . . . and a tenth SF) on a time base, and the sub-fields have luminance weights of 0.5, 1, 2, 3, 6, 9, 15, 22, 30, and 40, respectively. In this way, the luminance weights of the plurality of sub-fields are set such that the sub-field temporally arranged later has the larger luminance weight. That is, the number of the sustain pulses in the sustain period of each sub-field is set such that the sub-field temporally arranged later has the larger number of the sustain pulses. A display luminance is the lowest in the first SF.

In addition, the pseudo-SF is provided in the period sandwiched between the tenth SF and the next field.

The first SF with the lowest display luminance does not have the setup period, and the other sub-fields have the setup periods, respectively. The setup operation for all the cells is performed in the setup period of the second SF following the first SF with the lowest display luminance, and the selective setup operations are performed in the setup periods of the other sub-fields. In addition, a gray scale display is performed by using a pulse having a wide portion in the first SF.

Figure 5:
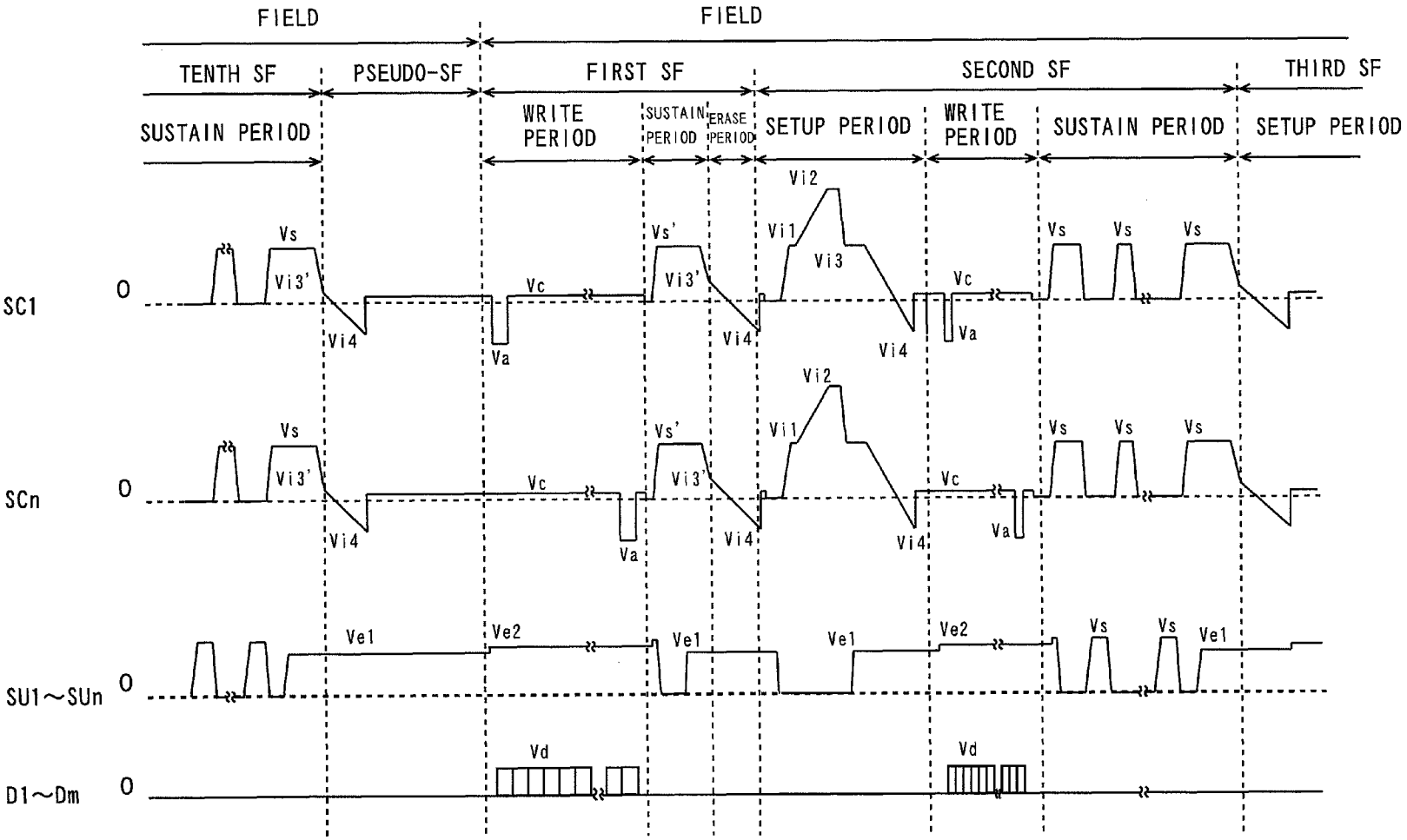
FIG. 5 is a driving voltage waveform diagram in a second sub-field configuration of the plasma display device of FIG. 3.

FIG. 5 is a driving voltage waveform diagram in the second sub-field configuration of the plasma display device of FIG. 3. FIG. 5 shows periods from the sustain period of the tenth SF of the preceding field to the setup period of the third SF of the next field.

The setup period is not provided in the first SF. The reason for this is as follows. In the pseudo-SF of the preceding field, a driving waveform applied to each electrode for suppressing the erroneous discharge is set so as to be equal to the driving waveform for the selective setup operation. Accordingly, the setup operation is also performed simultaneously in the pseudo-SF of the preceding field. Details will be described later. Note that the setup period in which the setup operation for all the cells is performed is provided in the second SF, described later.

In the write period of the first SF, the voltage Ve2 is applied to the sustain electrodes SU1 to SUn, and the scan electrodes SC1 to SCn are temporarily kept at the voltage Vc. Then, the write pulse voltage Vd is applied to the data electrode Dk (k is any of 1 to m), among the data electrodes D1 to Dm, of the discharge cell that should emit light on the first line while the scan pulse voltage Va is applied to the scan electrode SC1 on the first line. Then, the write discharge is generated in the discharge cell that should emit light on the first line, so that the write operation is performed. The above-described write operation is sequentially performed in the discharge cells on the first line to the n-th line, and the write period is then finished.

In the second sub-field configuration, the pulse widths of the scan pulse and the write pulse in the write period of the first SF are set larger than the pulse widths of the scan pulses or the pulse widths of the write pulses in the write periods of the second SF to the tenth SF. Moreover, the pulse widths of the scan pulse and the write pulse in the write period of the first SF in the second sub-field configuration are set larger than the pulse width of the scan pulse or the pulse width of the write pulse in the write period of each sub-field in the first sub-field configuration. The reason for this is as follows.

Since an elapsed time from the setup operation for all the cells in the second SF of the preceding field to the write period of the first SF of the field succeeding the foregoing field is long, the discharge time lag tends to become large because of shortage of the priming. Therefore, the pulse widths of the scan pulse and the write pulse are set sufficiently large so that the write discharge is reliably generated even in the discharge cell with the large discharge lag. In the present embodiment, the pulse widths of the scan pulse and the write pulse in the write period of the first SF in the second sub-field configuration are set to 3 μs which is about twice as large as the pulse widths of the scan pulses and the write pulses in the write periods of the other sub-fields.

Furthermore, the positive voltage Ve2 is applied to the sustain electrodes SU1 to SUn in the write period of the first SF, and the positive voltage Ve2 is also applied to the sustain electrodes SU1 to SUn similarly in the write periods of the other sub-fields in the second sub-field configuration. The reason for this is as follows.

In the first SF, the pulse widths of the scan pulse and the write pulse are large, and a time interval for generating the write discharge is long. Therefore, if the voltage applied to the sustain electrodes SU1 to SUn are set high, the write discharges are liable to be easily generated to induce the erroneous lighting cells. Accordingly, the voltage Ve2 that is lower than the voltage Ve3 is applied to the sustain electrodes SU1 to SUn in the write period of the sub-field in which the pulse width of the scan pulse or the write pulse is set large (the first SF in the present embodiment) so that such erroneous lighting cells are not induced.

In the subsequent sustain period of the first SF, the sustain electrodes SU1 to SUn are returned to 0 V, and a sustain pulse voltage Vs' having the wide portion is applied to the scan electrodes SC1 to SCn. Here, the voltage between the scan electrodes SCi and the sustain electrodes SUi becomes a value in which the wall voltage on the scan electrodes SCi and the wall voltage on the sustain electrodes SUi are added to the sustain pulse voltage Vs' having the wide portion, and exceeds the discharge start voltage in the discharge cells in which the write discharges have been generated. Thus, the sustain discharges are induced between the scan electrodes SCi and the sustain electrodes SUi, causing the discharge cells to emit light. In the discharge cells in which the write discharges have not been generated in the write period, the sustain discharges are not induced and the wall charges are kept in a state at the end of the pseudo-SF.

Note that an erase period is provided after the sustain period of the first SF in the present embodiment. In this erase period, the sustain electrodes SU1 to SUn are kept at the positive voltage Ve1, and the lamp voltage that gradually drops from the positive voltage Vi3' toward the negative voltage Vi4 is applied to the scan electrodes SC1 to SCn. Thus, the wall charges of the discharge cells in which the sustain discharges have been induced in the immediately preceding sustain period are adjusted. The voltage applied to the sustain electrodes and the scan electrodes in this erase period is the same as the voltage in the setup periods of the second SF to the tenth SF in the first sub-field configuration and the voltage in the setup periods of the third SF to the tenth SF in the second sub-field configuration.

Next, the setup operation for all the cells is performed in the setup period of the second SF. That is, the data electrodes D1 to Dm and the sustain electrodes SU1 to SUn are held at 0 V, and the lamp voltage is applied to the scan electrodes SC1 to SCn in the first half of the setup period. This lamp voltage gradually rises from the positive voltage Vi1 that is not more than the discharge start voltage toward the positive voltage Vi2 that exceeds the discharge start voltage. Then, the sustain electrodes SU1 to SUn are kept at the positive voltage Ve1 and the lamp voltage that gradually drops from the positive voltage Vi3 toward the negative voltage Vi4 is applied to the scan electrodes SC1 to SCn in the second half of the setup period. In this way, the wall voltage on each electrode is adjusted to a value suitable for the write operation in all the discharge cells.

In the present embodiment, the setup operation for all the cells is performed only in the second SF in the second sub-field configuration. Thus, the elapsed time from the setup operation for all the cells to the write period of the next first SF is long, and an effect of the priming in the write period of the first SF is small as described above.

The write operation that is the same as those in the write periods of the second SF to the tenth SF in the first sub-field configuration is performed in the write period of the second SF. That is, the voltage Ve2 is applied to the sustain electrodes SU1 to SUn, and the scan electrodes SC1 to SCn are temporarily held at the voltage Vc. Next, the positive write pulse voltage Vd is applied to the data electrode Dk, among the data electrodes D1 to Dm, of the discharge cell that should emit light on the first line while the negative scan pulse voltage Va is applied to the scan electrode SC1 on the first line. Then, the write discharge is generated between the data electrode Dk and the scan electrode SC1 and between the sustain electrode SU1 and the scan electrode SC1. The above-described write operation is sequentially performed in the discharge cells on the first line to the n-th line, and the write period is then finished.

The sustain operation that is the same as those in the sustain periods of the first SF to the tenth SF in the first sub-field configuration is performed in the subsequent sustain period. That is, the sustain pulses are applied alternately to the scan electrodes SC1 to SCn and the sustain electrodes SU1 to SUn. Thus, the sustain discharges are induced in the discharge cells in which the write discharges have been generated in the write period. In this way, the sustain operation in the sustain period is finished.

Since the setup periods, the write periods and the sustain periods of the third SF to the tenth SF in the second sub-field configuration are the same as the setup periods, the write periods and the sustain periods of the second SF to the tenth SF in the first sub-field configuration except for the number of the sustain pulses, explanation is omitted.

In the pseudo-SF following the tenth SF, the voltage Ve1 is applied to the sustain electrodes SU1 to SUn, the data electrodes D1 to Dm are kept at 0 V, the lamp voltage that gradually drops from the positive voltage Vi3' toward the negative voltage Vi4 is applied to the scan electrodes SC1 to SCn similarly to the pseudo-SF in the first sub-field configuration. Then, the weak setup discharges are generated in the discharge cells in which the sustain discharges have been induced in the sustain period of the immediately preceding sub-field (the tenth SF in the present embodiment). After that, a constant voltage is applied to each electrode. In the present embodiment, the voltage Vc is applied to the scan electrodes SC1 to SCn, the voltage Ve1 is applied to the sustain electrodes SU1 to SUn, and the data electrodes D1 to Dm are kept at 0 V.

In this way, the setup period can be omitted and a driving time can be shortened in the first SF of the next field.

(6) Circuit Configuration of the Sustain Electrode Driving Circuit 54

Figure 6:
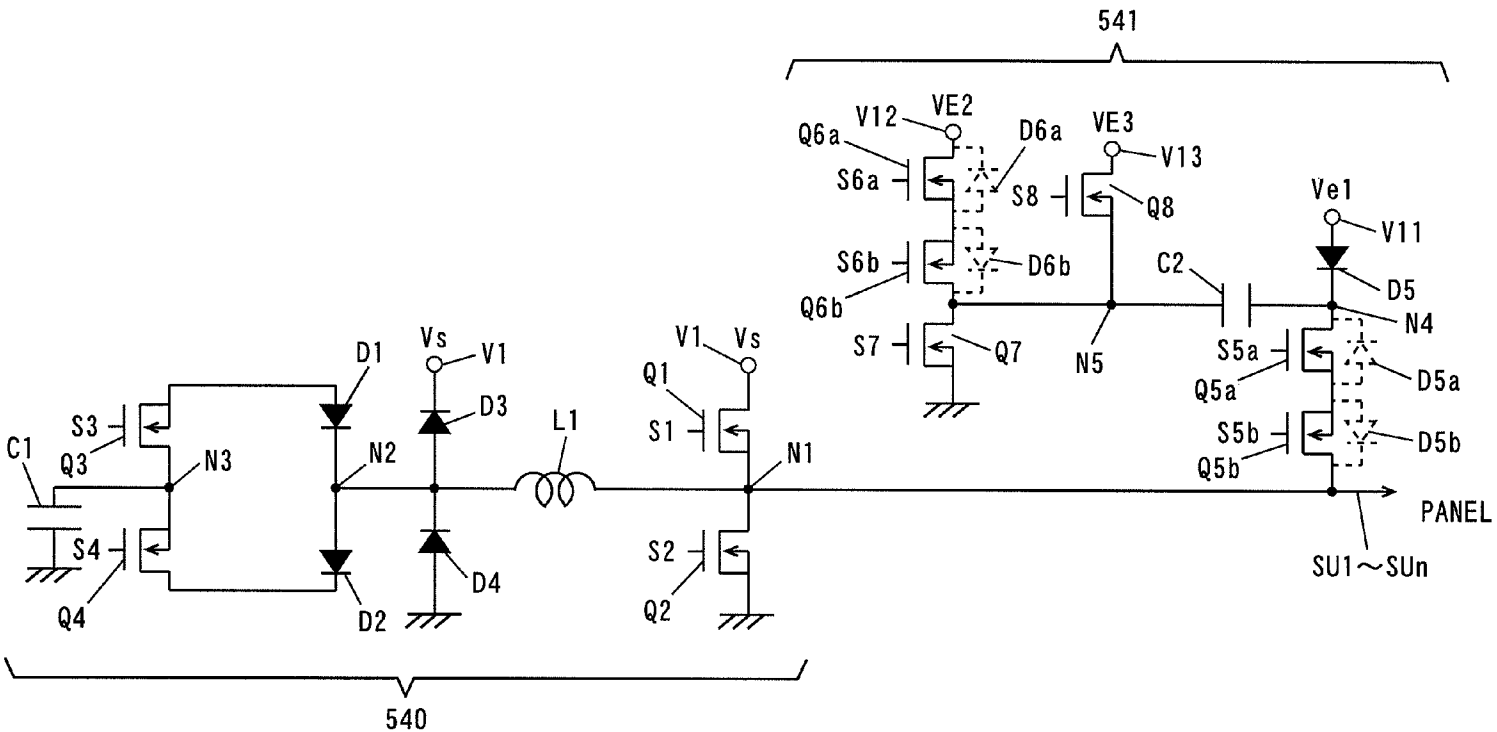
FIG. 6 is a circuit diagram showing a configuration of a sustain electrode driving circuit of FIG. 1.

FIG. 6 is a circuit diagram showing a configuration of the sustain electrode driving circuit 54 of FIG. 1.

The sustain electrode driving circuit 54 of FIG. 6 includes a sustain driver 540 and a voltage raising circuit 541.

The sustain driver 540 of FIG. 6 includes n-channel FETs (field-effect transistors; hereinafter abbreviated as transistors) Q1 to Q4, a recovery capacitor C1, a recovery coil L1 and diodes D1 to D4.

The voltage raising circuit 541 includes n-channel FETs (field-effect transistors; hereinafter abbreviated as transistors) Q5*a*, Q6*a*, Q7, Q8, p-channel FETs (field-effect transistors; hereinafter abbreviated as transistors) Q5*b*, Q6*b*, a diode D5 and a capacitor C2.

The transistor Q1 of the sustain driver 540 is connected between a power supply terminal V1 and a node N1, and a control signal S1 is input to a gate. The voltage Vs is applied to the power supply terminal V1. The transistor Q2 is connected between the node N1 and a ground terminal, and a control signal S2 is input to a gate. The node N1 is connected to the sustain electrodes SU1 to SUn of FIG. 2.

The recovery capacitor C1 is connected between a node N3 and a ground terminal. The transistor Q3 and the diode D1 are connected in series between the node N3 and a node N2. The diode D2 and the transistor Q4 are connected in series between the node N2 and the node N3. A control signal S3 is input to a gate of the transistor Q3, and a control signal S4 is input to a gate of the transistor Q4. The recovery coil L1 is connected between the node N1 and the node N2. The diode D3 is connected between the node N2 and a power supply terminal V1, and the diode D4 is connected between a ground terminal and the node N2.

The diode D5 of the voltage raising circuit 541 is connected between a power supply terminal V11 and a node N4, and the voltage Ve1 is applied to the power supply terminal V11.

The transistor Q5*a* and the transistor Q5*b* are connected in series between the node N4 and the node N1. A control signal S5*a* and a control signal S5*b* are input to gates of the transistor Q5*a* and the transistor Q5*b*, respectively. The capacitor C2 is connected between the node N4 and a node N5.

The transistor Q6*a* and the transistor Q6*b* are connected in series between a power supply terminal V12 and the node N5. A control signal S6*a* and a control signal S6*b* are input to gates of the transistor Q6*a* and the transistor Q6*b*, respectively. A voltage VE2 is applied to the power supply terminal V12. Note that the voltage VE2 satisfies a relation of VE2=Ve2−Ve1, such as VE2=5 [V], for example. The transistor Q7 is connected between the node N5 and a ground terminal, and a control signal S7 is input to a gate.

The transistor Q8 is connected between a power supply terminal V13 and the node N5, and a control signal S8 is input to a gate. A voltage VE3 is applied to the power supply terminal V13. The voltage VE3 satisfies a relation of VE3=Ve3−Ve1, such as VE3=10 [V], for example.

The above-mentioned control signals S1 to S4, S5*a*, S5*b*, S6*a*, S6*b*, S7, S8 are provided from the timing generating circuit 55 of FIG. 2 to the sustain electrode driving circuit 54 as timing signals.

(7) Operation of the Sustain Electrode Driving Circuit 54

Figure 7:
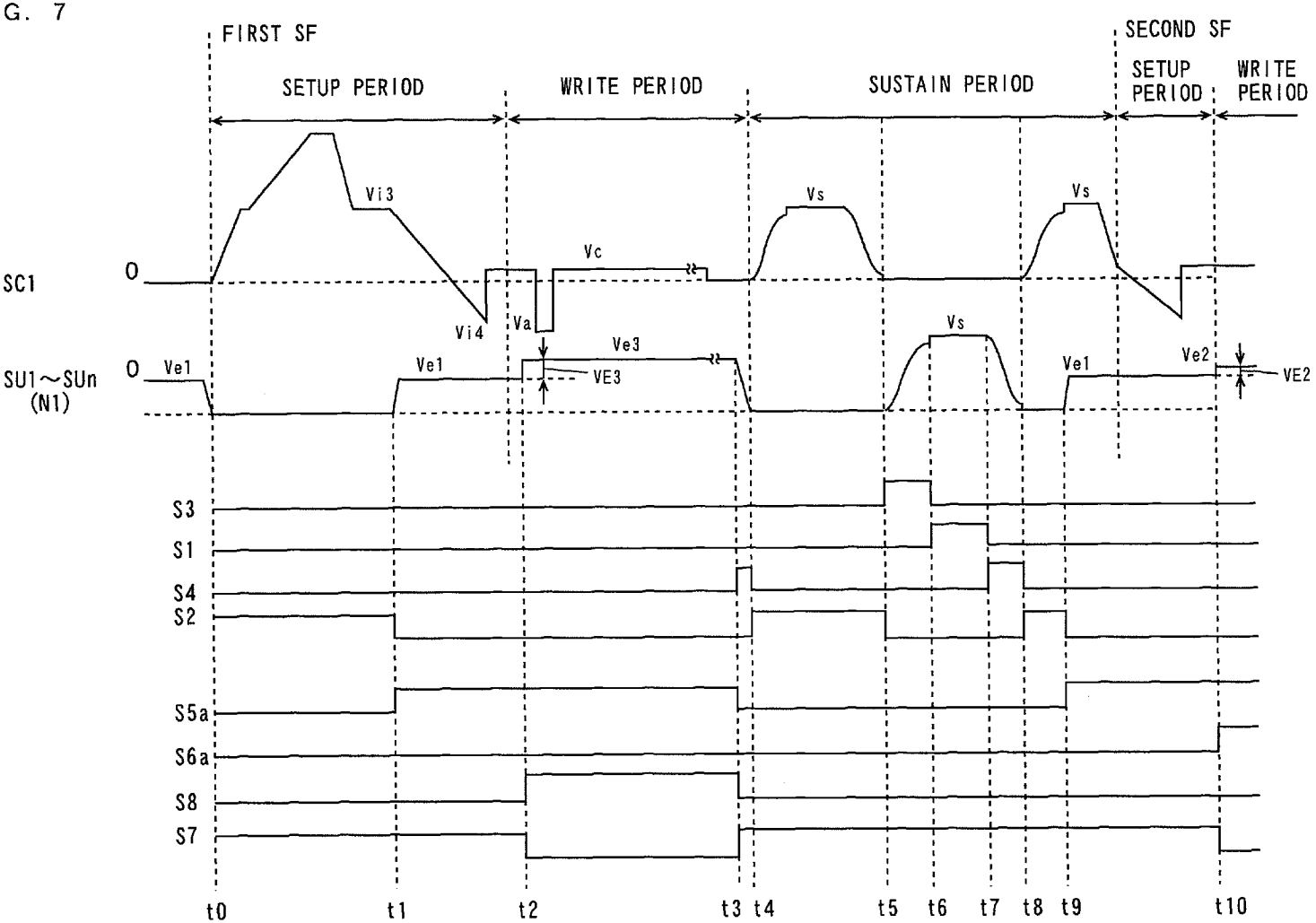
FIG. 7 is a timing chart showing an operation of the sustain electrode driving circuit of FIG. 6.

FIG. 7 is a timing chart showing an operation of the sustain electrode driving circuit 54 of FIG. 6. FIG. 7 shows a driving waveform applied to the scan electrode SC1, a driving waveform applied to the sustain electrodes SU1 to SUn, and the control signals S1 to S4, S5*a*, S6*a*, S7, S8. The control signal S5*b* has a waveform that is inverted with respect to a waveform of the control signal S5*a*, and the control signal S6*b* has a waveform that is inverted with respect to the waveform of the control signal S5*a*. In FIG. 7, the control signals S5*b*, S6*b* are not shown. FIG. 7 also shows the setup period, the write period and the sustain period of the first SF and the setup period and the write period of the second SF in the first sub-field configuration.

At a starting point t0 in the setup period of the first SF, the control signals 51, S3, S4, S5*a*, S6*a*, S8 are at respective low levels, and the control signals S2, S5*b*, S6*b*, S7 are at respective high levels. Accordingly, the transistors Q1, Q3, Q4, Q5*a*, Q5*b*, Q6*a*, Q6*b* and Q8 are turned off. The transistors Q2, Q7 are turned on. Accordingly, the voltages of the sustain electrodes SU1 to SUn (the node N1) and the node N5 are 0 V (a ground potential).

The control signal S2 is at a low level and the transistor Q2 is turned off at a time point t1 in the setup period. In addition, the control signal S5*a* is at a high level and the transistor Q5*a* is turned on while the control signal S5*b* is at a low level and the transistor Q5*b* is turned on. This causes a current to flow from the power supply terminal V11 to the node N1 through the diode D5 and the transistors Q5*a*, Q5*b*. As a result, the voltage of the sustain electrodes SU1 to SUn (the node N1) rises to Ve1.

Next, the control signal S7 is at a low level and the transistor Q7 is turned off at a time point t2 in the write period. In addition, the control signal S8 is at a high level and the transistor Q8 is turned on. Thus, the current flows from the power supply terminal V13 into the node N5 through the transistor Q8. As a result, the voltage of the node N5 rises to VE3. In this case, the voltage VE3 is added to the voltage Ve1 of the sustain electrodes SU1 to SUn (the node N1). Thus, the voltage of the sustain electrodes SU1 to SUn (the node N1) rises to Ve3.

Then, the control signal S5*a* is at a low level and the transistor Q5*a* is turned off while the control signal S5*b* is at a high level and the transistor Q5*b* is turned off at a time point t3 in the write period. Moreover, the control signal S8 is at a low level and the transistor Q8 is turned off. Furthermore, the control signal S4 is at a high level and the transistor Q4 is turned on while the control signal S7 is at a high level and the transistor Q7 is turned on. Thus, the current flows from the sustain electrodes SU1 to SUn (the node N1) into the recovery capacitor C1 through the recovery coil L1, the diode D2 and the transistor Q4.

At this time, charges in a panel capacitance are recovered to the recovery capacitor C1. As a result, the voltage of the sustain electrodes SU1 to SUn (the node N1) drops, and the voltage of the node N5 becomes 0 V.

Next, the control signal S4 is at a low level and the transistor Q4 is turned off while the control signal S2 is at a high level and the transistor Q2 is turned on at a starting point t4 of the sustain period. Thus, the voltage of the sustain electrodes SU1 to SUn (the node N1) is maintained at 0 V.

Then, the control signal S2 is at a low level and the transistor Q2 is turned off while the control signal S3 is at a high level and the transistor Q3 is turned on at a time point t5 in the sustain period. This causes the current to flow from the recovery capacitor C1 into the sustain electrodes SU1 to SUn (the node N1) through the transistor Q3, the diode D1 and the recovery coil L1. As a result, the voltage of the sustain electrodes SU1 to SUn (the node N1) rises.

At a subsequent time point t6 in the sustain period, the control signal S1 is at a high level and the transistor Q1 is turned on while the control signal S3 is at a low level and the transistor Q3 is turned off. Thus, the voltage of the sustain electrodes SU1 to SUn (the node N1) is fixed at Vs, and one sustain discharge is generated by a discharge current supplied from the power supply terminal V1.

Next, the control signal S1 is at a low level and the transistor Q1 is turned off while the control signal S4 is at a high level and the transistor Q4 is turned on at a time point t7 in the sustain period. Thus, the current flows from the sustain electrodes SU1 to SUn (the node N1) into the recovery capacitor C1 through the recovery coil L1, the diode D2 and the transistor Q4, and the voltage of the sustain electrodes SU1 to SUn (the node N1) drops.

Then, the control signal S2 is at a high level and the transistor Q2 is turned on while the control signal S4 is at a low level and the transistor Q4 is turned off at a time point t8 in the sustain period. Accordingly, the voltage of the sustain electrodes SU1 to SUn (the node N1) is fixed at 0 V.

The above-described operation is performed repeatedly in the sustain period, so that the sustain pulses are applied to the sustain electrodes SU1 to SUn, and the sustain discharges in the discharge cells are performed at the rising of the sustain pulses. Note that FIG. 7 shows one sustain pulse applied to the sustain electrodes SU1 to SUn in the sustain period.

The control signal S2 is at a low level and the transistor Q2 is turned off at a time point t9 in the sustain period. Moreover, the control signal S5*a* is at a high level and the transistor Q5*a* is turned on while the control signal S5*b* is at a low level and the transistor Q5*b* is turned on. This causes the current to flow from the power supply terminal V11 to the node N1 through the diode D5 and the transistors Q5*a*, Q5*b*. As a result, the voltage of the sustain electrodes SU1 to SUn (the node N1) rises to Ve1.

Next, the voltage of the sustain electrodes SU1 to SUn (the node N1) is maintained at Ve1 in the setup period of the second SF.

The control signal S7 is at a low level and the transistor Q7 is turned off at a starting point t10 of the write period of the second SF. In addition, the control signal S6*a* is at a high level and the transistor Q6*a* is turned on while the control signal S6*b* is at a low level and the transistor Q6*b* is turned on. This causes the current to flow from the power supply terminal V12 to the node N5 through the transistor Q6*a* and the transistor Q6*b*. As a result, the voltage of the node N5 rises to VE2. In this case, the voltage VE2 is added to the voltage Ve1 of the sustain electrodes SU1 to SUn (the node N1). This causes the voltage of the sustain electrodes SU1 to SUn (the node N1) to rise to Ve2.

(8) Functions of the Transistors Q5*a*, Q5*b*, Q6*a* and Q6*b*

Here, the reason why the two transistors Q5*a*, Q5*b* are connected in series between the node N4 and the node N1 and the reason why the two transistors Q6*a*, Q6*b* are connected in series between the power supply terminal V12 and the node N5 as shown in FIG. 6 described above will be explained.

The transistor Q5*a* includes a parasitic diode D5*a* and the transistor Q5*b* includes a parasitic diode D5*b*.

Here, a case where only the transistor Q5*a*, for example, is connected between the node N4 and the node N1 is considered. The voltage Vs is higher than the voltage Ve1. When the transistor Q1 is turned on, the current flows from the power supply terminal V1 into the node N4 through the transistor Q1 and the parasitic diode D5*a* of the transistor Q5*a*, and the capacitor C2 is charged to the voltage Vs.

When the transistor Q5*a* is turned on in this state, not the voltage Ve1 but the voltage Vs of the capacitor C2 is applied to the sustain electrodes SU1 to SUn (the node N1).

Therefore, the transistor Q5*b* is connected in series with the transistor Q5*a* in the present embodiment. In this case, the parasitic diode D5*b* of the transistor Q5*b* is connected oppositely to the parasitic diode D5*a* of the transistor Q5*a*. Thus, the parasitic diode D5*b* of the transistor Q5*b* prevents the flow of the current from the power supply terminal V1 in a direction of the capacitor C2 when the transistor Q1 is turned on. As a result, when the transistors Q5*a*, Q5*b* are turned on, the voltage Ve1 is applied to the sustain electrodes SU1 to SUn (the node N1).

In addition, the transistor Q6*a* includes a parasitic diode D6*a*, and the transistor Q6*b* includes a parasitic diode D6*b*.

Here, a case where only the transistor Q6*a*, for example, is connected between the power supply terminal V12 and the node N5 is considered. The voltage VE3 is higher than the voltage VE2. When the transistor Q8 is turned on, the current flows from the power supply terminal V13 into the power supply terminal V12 through the transistor Q8 and the parasitic diode D6*a* of the transistor Q6*a*. Thus, the capacitor C2 is not charged to the voltage VE3 while the current is unnecessarily consumed. Therefore, not the voltage Ve3 but the voltage Ve2 is applied to the sustain electrodes SU1 to SUn (the node N1).

Therefore, the transistor Q6*b* is connected in series with the transistor Q6*a* in the present embodiment. In this case, the parasitic diode D6*b* of the transistor Q6*b* is connected oppositely to the parasitic diode D6*a* of the transistor Q6*a*. Accordingly, the parasitic diode D6*b* of the transistor Q6*b* prevents the flow of the current from the power supply terminal V13 in a direction of the power supply terminal V12 when the transistor Q8 is turned on. As a result, the voltage Ve3 is applied to the sustain electrodes SU1 to SUn (the node N1).

(9) Another Embodiment

While the luminance weight of each sub-field is set so as not to be larger than the luminance weight of its succeeding sub-field that is arranged later than each sub-field in the above-described embodiment, the number of the sub-fields or the luminance weight of each sub-field is not limited to the above-described embodiment. For example, one field may be divided into 12 sub-fields (a first SF, a second SF . . . and a twelfth SF), and the luminance weights of these sub-fields may be set to 1, 2, 4, 8, 16, 32, 56, 4, 12, 24, 40 and 56, respectively. That is, the present invention can also be applied to a case where one field is constituted by two or more sub-field groups each having the increasing luminance weights.

(10) Correspondences Between Elements in the Claims and Parts in Embodiments

In the following paragraphs, non-limiting examples of correspondences between various elements recited in the claims below and those described above with respect to various preferred embodiments of the present invention are explained.

In the above-described embodiment, the sustain driver 540 of the sustain electrode driving circuit 54 is an example of a driving circuit, the timing generating circuit 55 is an example of a selection unit, the voltage raising circuit 541 of the sustain electrode driving circuit 54 is an example of a voltage setting circuit. The sustain electrode driving circuit 54 and the timing generating circuit 55 are examples of driving devices.

The power supply terminal V11 is an example of a first node, the power supply terminal V12 is an example of a second node, the power supply terminal V13 is an example of a third node, and the node N5 is an example of a fourth node. The voltage Ve1 is an example of a first voltage, the voltage VE2 is an example of a second voltage, and the voltage VE3 is an example of a third voltage.

The capacitance C2 and the transistors Q6*a*, Q6*b*, Q8 are examples of addition circuits, the transistors Q5*a*, Q5*b* are examples of first switching circuits, the transistors Q6*a*, Q6*b* are examples of second switching circuits, and the transistor Q8 is an example of a third switching circuit. The transistor Q5*a* or the transistor Q6*a* is an example of an n-channel switching device, the transistor Q5*b* or the transistor Q6*b* is an example of a p-channel switching device, and the transistor Q7 or the transistor Q8 is an example of a switching device.

INDUSTRIAL APPLICABILITY

The present invention is applicable to a display device that displays various types of images.

The invention claimed is:

1. A driving device that drives a plasma display panel including a plurality of discharge cells at intersections of a scan electrode and a sustain electrode with a plurality of data electrodes by a sub-field method where one field period includes a plurality of sub-fields, comprising:

a driver that generates a write discharge by selectively applying a write pulse to said plurality of discharge cells in a write period of each of the sub-fields and causes a discharge cell in which said write discharge has been generated to emit light with a predetermined display luminance in a sustain period;

a selector that selects any of a first sub-field configuration where a width of write pulse in a sub-field with a lowest display luminance is not more than widths of the write pulses in other sub-fields and a second sub-field configuration where the width of the write pulse in the sub-field with the lowest display luminance is larger than the widths of the write pulses in the other sub-fields; and a voltage setter that sets a voltage applied to said sustain electrode in the write period of the sub-field with the lowest display luminance higher than a voltage applied to said sustain electrode in the write periods of the other sub-fields when said first sub-field configuration is selected by said selector and sets the voltage applied to said sustain electrode in the write period of the sub-field with the lowest display luminance to be the same as the voltage applied to said sustain electrode in the write period of any of the other sub-fields when the second sub-field configuration is selected by said selector, wherein the sub-field with the lowest display luminance in said second sub-field configuration is a sub-field that does not include a setup period in which setup discharges are performed in part or all of said plurality of discharge cells.

2. The driving device according to claim 1, wherein the sub-field with the lowest display luminance in said first sub-field configuration is a sub-field that includes a setup period in which setup discharges are performed in all of said plurality of discharge cells.

3. The driving device according to claim 1, wherein a sub-field following the sub-field with the lowest display luminance in said second sub-field configuration is a sub-field that includes a setup period in which setup discharges are performed in all of said plurality of discharge cells.

4. The driving device according to claim 1, wherein the sub-field with the lowest display luminance in said second sub-field configuration is a sub-field for causing the discharge cell in which said write discharge has been generated to emit light by using a pulse with a larger width than widths of pulses of the other sub-fields.

5. A driving device that drives a plasma display panel including a plurality of discharge cells at intersections of a scan electrode and a sustain electrode with a plurality of data electrodes by a sub-field method where one field period includes a plurality of sub-fields, comprising:

a driver that generates a write discharge by selectively applying a write pulse to said plurality of discharge cells in a write period of each of the sub-fields and causes a discharge cell in which said write discharge has been generated to emit light with a predetermined display luminance in a sustain period;

a selector that selects any of a first sub-field configuration where a width of the write pulse in a sub-field with a lowest display luminance is not more than widths of write pulses in other sub-fields and a second sub-field configuration where the width of the write pulse in the sub-field with the lowest display luminance is larger than the widths of the write pulses in the other sub-fields; and a voltage setter that sets a voltage applied to said sustain electrode in the write period of the sub-field with the lowest display luminance higher than a voltage applied to said sustain electrode in the write periods of the other sub-fields when said first sub-field configuration is selected by said selector and sets the voltage applied to said sustain electrode in the write period of the sub-field with the lowest display luminance to be the same as the voltage applied to said sustain electrode in the write period of any of the other sub-fields when the second sub-field configuration is selected by said selector, wherein said voltage setter includes a first node that receives a first voltage, a second node that receives a second voltage, a third node that receives a third voltage that is higher than said second voltage, an adder that adds the second voltage of said second node or the third voltage of said third node to the first voltage of said first node, and a first switcher that provides a voltage obtained by said adder to said sustain electrode in the write period of each of the sub-fields, and said adder adds, when said first sub-field configuration is selected by said selector, the third voltage of said third node to the first voltage of said first node in the write period of the sub-field with the lowest display luminance and adds the second voltage of said second node to the first voltage of said first node in the write periods of the other sub-fields, and adds, when the second sub-field configuration is selected by said selector, the second voltage of said second node to the first voltage of said first node in the write periods of the sub-field with the lowest display luminance and any of the other sub-fields.

6. The driving device according to claim 5, wherein said first switcher is connected between said first node and said sustain electrode, and said adder includes a capacitance connected between said first node and a fourth node, a second switcher connected between said second node and said fourth node, and a third switcher connected between said third node and said fourth node.

7. The driving device according to claim 6, wherein said first switcher includes an n-channel switcher and a p-channel switcher connected in series between said first node and said sustain electrode.

8. The driving device according to claim 6, wherein said second switcher includes a switcher connected in series between said second node and said fourth node.

9. The driving device according to claim 6, wherein said third switcher includes an n-channel switcher and a p-channel switcher connected in series between said third node and said fourth node.

10. The driving device according to claim 6, wherein said adder further includes a switcher connected in series between said fourth node and a ground terminal.

11. A driving method of a plasma display panel that includes a plurality of discharge cells at intersections of a scan electrode and a sustain electrode with a plurality of data electrodes, wherein one field period includes a plurality of sub-fields each including a write period for generating a write discharge by selectively applying a write pulse to said plurality of discharge cells and a sustain period for causing a discharge cell in which said write discharge has been generated to emit light with a predetermined display luminance, and said plurality of sub-fields include any of a first sub-field configuration where a width of the write pulse in a sub-field with a lowest display luminance is not more than widths of write pulses in other sub-fields and a second sub-field configuration where the width of the write pulse in the sub-field with the lowest display luminance is larger than the widths of the write pulses in the other sub-fields, said driving method of the plasma display panel comprising:

selecting any of said first sub-field configuration and said second sub-field configuration;

setting a voltage applied to said sustain electrode in the write period of the sub-field with the lowest display luminance higher than a voltage applied to said sustain electrode in the write periods of the other sub-fields when said first sub-field configuration is selected; and setting the voltage applied to said sustain electrode in the write period of the sub-field with the lowest display luminance to be the same as the voltage applied to said sustain electrode in the write period of any of the other sub-fields when said second sub-field configuration is selected, wherein the sub-field with the lowest display luminance in said second sub-field configuration is a sub-field that does not include a setup period in which setup discharges are performed in part or all of said plurality of discharge cells.

12. The driving method of the plasma display panel according to claim 11, wherein the sub-field with the lowest display luminance in said first sub-field configuration is a sub-field that includes a setup period in which setup discharges are performed in all of said plurality of discharge cells.

13. The driving method of the plasma display panel according to claim 11, wherein a sub-field following the sub-field with the lowest display luminance in said second sub-field configuration is a sub-field that includes a setup period in which setup discharges are performed in all of said plurality of discharge cells.

14. The driving method of the plasma display panel according to claim 11, wherein the sub-field with the lowest display luminance in said second sub-field configuration is a sub-field for causing the discharge cell in which said write discharge has been generated to emit light by using a pulse with a larger width than widths of pulses of the other sub-fields.

15. A plasma display device, comprising:

a plasma display panel including a plurality of discharge cells at intersections of a scan electrode and a sustain electrode with a plurality of data electrodes;

a driver that drives said plasma display panel by a sub-field method where one field period includes a plurality of sub-fields, generates a write discharge by selectively applying a write pulse to said plurality of discharge cells in a write period of each of the sub-fields and causes a discharge cell in which said write discharge has been generated to emit light with a predetermined display luminance in a sustain period;

a selector that selects any of a first sub-field configuration where a width of the write pulse in a sub-field with a lowest display luminance is not more than widths of write pulses in other sub-fields and a second sub-field configuration where the width of the write pulse in the sub-field with the lowest display luminance is larger than the widths of the write pulses in the other sub-fields; and a voltage setter that sets a voltage applied to said sustain electrode in the write period of the sub-field with the lowest display luminance higher than a voltage applied to said sustain electrode in the write periods of the other sub-fields when said first sub-field configuration is selected by said selector and sets the voltage applied to said sustain electrode in the write period of the sub-field with the lowest display luminance to be the same as the voltage applied to said sustain electrode in the write period of any of the other sub-fields when the second sub-field configuration is selected by said selector, wherein the sub-field with the lowest display luminance in said second sub-field configuration is a sub-field that does not include a setup period in which setup discharges are performed in part or all of said plurality of discharge cells.

* * * * *